US006459051B1

(12) United States Patent
Barkley

(10) Patent No.: US 6,459,051 B1
(45) Date of Patent: Oct. 1, 2002

(54) MODULE FOR SELECTION OF POWER SOURCE

(75) Inventor: Steven D. Barkley, Medina, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 35 days.

(21) Appl. No.: 09/654,796

(22) Filed: Sep. 5, 2000

(51) Int. Cl.[7] ..... H01H 15/00
(52) U.S. Cl. ..... 200/16 E; 200/547
(58) Field of Search ..... 200/16 A, 16 B, 200/16 E, 547, 549

(56) References Cited

U.S. PATENT DOCUMENTS

| | | | | |
|---|---|---|---|---|
| 4,394,549 A | | 7/1983 | Dennis | |
| 4,436,968 A | * | 3/1984 | Giulie | 200/16 X |
| 4,725,698 A | | 2/1988 | Takai et al. | |
| 4,871,885 A | | 10/1989 | Kamada | |

FOREIGN PATENT DOCUMENTS

EP 0 352 920 1/1990

OTHER PUBLICATIONS

"Homeworx™—Modem Technology vs. HFC Ingress Noise", ADC Telecommunications publication, Feb. 1998.
"Balancing Service Revenue With Network Investment", ADC Channel, Spring 1996.
"ADC's DV6000™ Attends Major Media Events, Transmits Broadcast Quality Video and Audio Signals", ADC Channel, Spring 1997.
"Homeworks™—ISU Integrated Services Unit", ADC Telecommunications publication, Jun. 1999.
"Homeworks™—HDT (GR–303)", ADC Telecommunications publication, Jul., 1999.
"Homeworks™—Home Integrated Service Unit", ADC Telecommunications publication, Feb., 2000.
"Cable Makes a Play For Voice—Update Your Playbook for IP", by Mathews and Skrivesth, *Communications Technology,* Mar., 1999.
"Securing A Lifeline for Cable Telephony—Which Residential Gateway is Best?"—Networking, *Advanced Networking Technology,* by Mathews and Skrivesth, Mar., 1999.

* cited by examiner

*Primary Examiner*—Renee Luebke
(74) *Attorney, Agent, or Firm*—Fogg Slifer Polglaze Leffert & Jay P.A.

(57) ABSTRACT

A sliding power switch is provided. The switch includes a power interface module having a first power port, a second power port and a third power port. The switch also includes a shunt adapted to engage with the power interface module in a first position so as to provide a first electrical path from one of the first, second, and third power ports to another one of the first, second, and third power ports and a second position so as to provide a second electrical path from one of the first, second, and third power ports to another of the first, second, and third power ports. The switch further includes a shunt retainer coupled to the shunt and adapted to aid in placing and removing the shunt from the first and second positions and a slide actuator adapted to engage with and enable the shunt retainer to slide from the first position to the second position.

68 Claims, 4 Drawing Sheets

MODULE FOR SELECTION OF POWER SOURCE

TECHNICAL FIELD

The present invention relates generally to the field of telecommunications and ore particularly to a power source selection module.

BACKGROUND

Telecommunication networks carry various types of information, e.g., voice, data, or video, between user equipment at diverse locations. A typical telecommunications network includes many components or modules that work together to make a connection between user equipment. For example, a telecommunications network typically includes terminals, access equipment, transport media, switches and other conventional equipment used to create connections for users.

A wide variety of transport media are used in telecommunications networks. Some of these transport media include fiber optic cables, conventional twisted pair lines, coaxial cables, microwave links and infrared links. Access equipment such as service units at a subscriber's location are often designed to receive information over one of the transport media. Further, in some systems, power is provided to components of the access equipment over the transport media. In other systems, power is provided to the access equipment via power at the subscriber's location or battery power. A service technician who travels to a user's location typically accomplishes installation of access equipment. The technician must be equipped to work with the variety of systems that exist from location to location in the network.

Service providers are burdened with stocking and in some instances manufacturing as well as stocking components for their access equipment designed for each transport medium. In addition, service personnel installing the components for the access equipment are required to have readily available components for the access equipment that are designed for use with each transport medium.

For the reasons stated above, and for other reasons stated below which will become apparent to those skilled in the art upon reading and understanding the present specification, there is a need in the art for multimode components for access equipment that works with a variety of transport media in telecommunications systems.

SUMMARY

The above mentioned problems with interfacing with multiple transmission media in telecommunications systems and other problems are addressed by embodiments of the present invention and will be understood by reading and studying the following specification. A power selection switch is provided which allows power input from more than one power source and selection between those power sources.

In one embodiment, a sliding power switch is provided. A sliding power switch has been described. The switch includes a power interface module having a first power port, a second power port and a third power port. The switch also includes a shunt adapted to engage with the power interface module in a first position so as to provide a first electrical path from one of the first, second, and third power ports to another one of the first, second, and third power ports and a second position so as to provide a second electrical path from one of the first, second, and third power ports to another of the first, second, and third power ports. The switch further includes a shunt retainer coupled to the shunt and adapted to aid in placing and removing the shunt from the first and second positions and a slide actuator adapted to engage with and enable the shunt retainer to slide from the first position to the second position.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Figure 1:
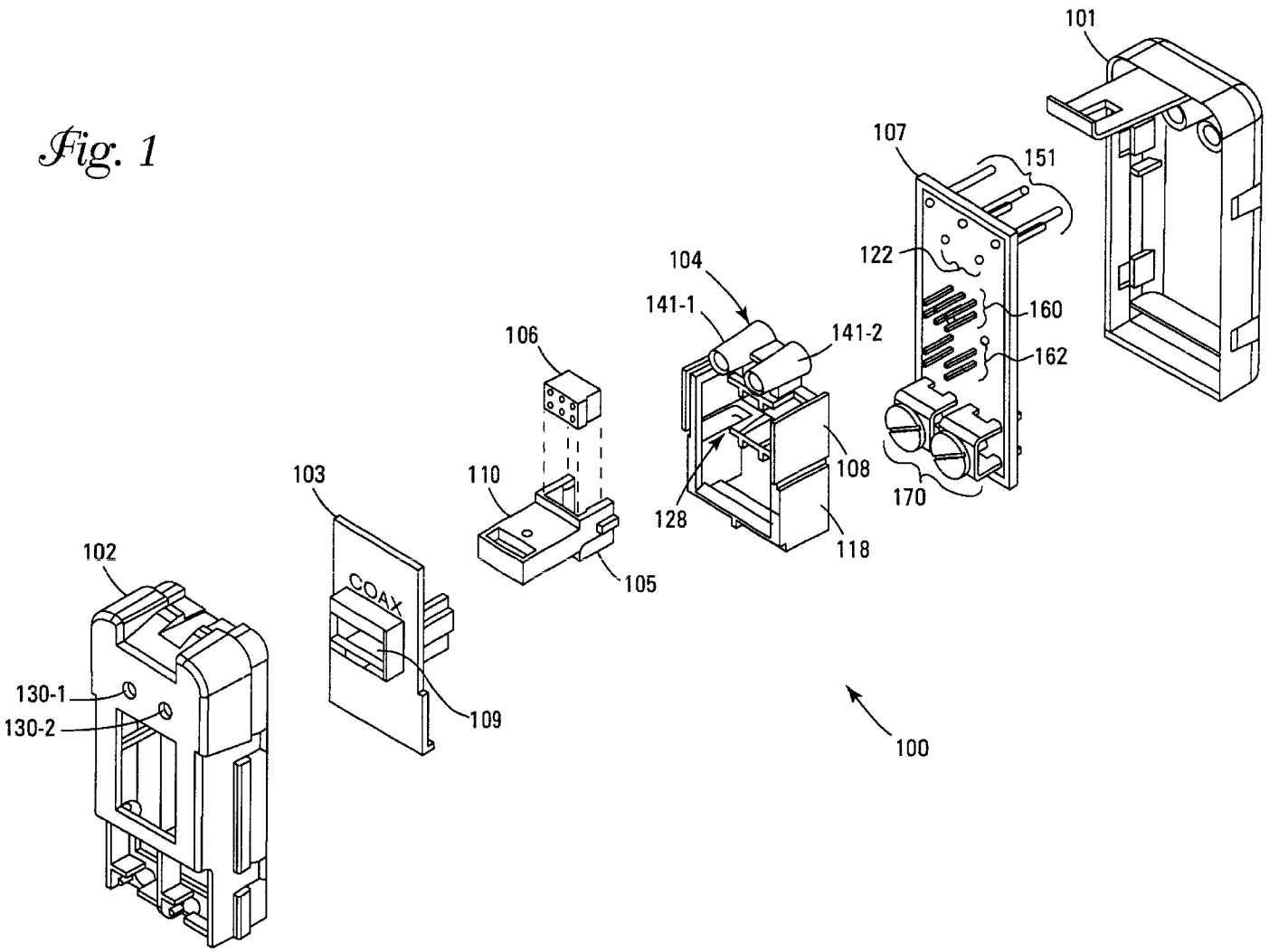
FIG. 1 is an illustration of the components of one embodiment of a sliding power switch according to the teachings of this invention.

FIG. 1 is an exploded, perspective view that illustrates components of one embodiment of a sliding power switch, shown generally at 100, constructed according to the teachings of this invention. Power switch 100 is a module for selection of a power source. Power switch 100 includes a sliding engagement mechanism that allows one of two inputs to be connected to an output. In one embodiment, power switch 100 couples to an integrated services unit and enables selection between two power sources.

Power switch 100 includes a power interface module 107 having a first power port 170, a second power port 122 and a third power port 151. In one embodiment, first power port 170 is a power input, second power port 122 is a combined power input and power output, and third power port 151 is a power output. In one embodiment, power interface module 107 comprises a printed circuit board, a wire-wrap board, or the like. In one embodiment, power ports 170, 122 and 151 each comprise one of terminals, screw terminals, insulation displacing connectors, binding posts, pins, screws, plugs, jacks, sockets, contact points, or the like. It is understood that first, second and third power ports 170, 122 and 151 may include one of a power input, a power output, or a combined power input and power output based on the application.

In one embodiment, power port 151 comprises a set of three poles. The three poles of power port 151 provide an output for power input via power port 170, in a first mode. And provides an output for power input via power port 122, in a second mode. In another embodiment, power input via power port 170 is output via power port 122, in a first mode and power input via power port 122 is output via power port 151 in a second mode.

In one embodiment, power interface module 107 includes a first header 160 and a second header 162. Headers 160 and 162 comprise pins that are electrically coupled to power interface module 107. In one embodiment, the pins of header 160 are configured in a first orientation and the pins of header 162 are configured in a second orientation. For example, in one embodiment, header 160 includes 6 pins configured into 3 columns with 2 pins per each column and header 162 includes 4 pins configured into 2 columns with two pins per each column. In one embodiment, each header 160 and 162 is set in a configuration capable of accommodating up to 6 pins each.

In one embodiment, power switch 100 includes shunt 106. In one embodiment, shunt 106 engages with power interface module 107 via headers 160 and 162. Shunt 106 includes receptacles that receive the pins of headers 160 and 162. In one embodiment, shunt 106 is a multi-position shunt and engages with different headers. In one embodiment, shunt 106 separately engages with headers 160 and 162. In one embodiment, shunt 106 engages with different headers, each header having pins with a different pin configuration. The pins of header 160 and 162 are configured so that when coupled to a shunt, such as shunt 106, power is allowed to flow through header 160 or 162, respectively. For example, in one embodiment, header 160 includes six pins configured into three columns of two pins and when engaged with a shunt, such as shunt 106, power input via power port 170 is allowed to flow to power port 151. In one embodiment, headers 160 and 162 each comprise receptacles instead of pins and shunt 106 comprises pins instead of receptacles.

When shunt 106 is engaged with power interface module 107 via header 160, a first electrical path is formed between, e.g. a pair of input terminals of power port 170 and power port 122. When shunt 106 is engaged with power interface module 107 via header 162, a second electrical path is formed between, e.g. power port 122 and power port 151.

In one embodiment, power switch 100 includes a shunt retainer 105 and a slide actuator 103. The shunt retainer 105 retains shunt 106 and aids in engaging shunt 106 with headers 160 and 162 of power interface module 107. In one embodiment, shunt retainer 105 includes an extended portion 110 that extends through a slot 109 of slide actuator 103. The extended portion 110 aids in placing shunt 106 in contact with power interface module 107 and also aids in removing or disconnecting shunt 106 from power interface module 107. The extended portion 110 of shunt retainer 105 is designed with one or more of a lip, a groove, an indent and/or a set of curves, that aids in grasping the shunt retainer 105 with fingertips or a tool such as tweezers, pliers, pincers or the like. In one embodiment, shunt retainer 105 includes a slot adapted to receive a flat head screwdriver. In one embodiment, the slot includes a fulcrum that aids in leveraging the screwdriver. In one embodiment, the extended portion 110 includes a set of grooves and an edge that allow shunt retainer 105 to be grasped with fingertips. In one embodiment, pulling out on the shunt retainer 105 and pushing in on the shunt retainer 105, respectively, accomplish engaging and disengaging the shunt 106 with power interface module 107. Slot 109 of slide actuator 103 acts as a guide and allows the extended portion 110 of shunt retainer 105 to move in and out as it engages and disengages with power interface module 107. In one embodiment, extended portion 110 is secured in place when shunt 106 is engaged with headers 160 or 162 via a rise such as a bump on extended portion 110 that mates together with a dimple, indent or groove on the inside of slot 109. In one embodiment, slot 109 is only large enough for the extended portion 110 of shunt retainer 105 to slide in and out but not through slot 109. Slot 109 prohibits shunt retainer 105 from being completely removed from power switch 100. By keeping the shunt retainer 105 captive there are no loose parts to be easily lost.

In one embodiment, slide actuator 103 guides shunt retainer 105, once the shunt 106 is fully disengaged from power interface module 107, in moving or sliding between headers 160 and 162. In one embodiment, slide actuator 103 includes a horizontal surface that extends to cover and restrict access or disable the pair of input terminals of power port 170 when slid from header 160 to header 162. In one embodiment, the horizontal surface of slide actuator 103 extends to cover and restrict access or disable the pair of test terminals 130-1 and 130-2 when slid from header 162 to header 160.

In one embodiment, power switch 100 further includes a housing comprised of a bottom portion 101 and a top portion 102. The top and bottom portions 102 and 101 fit together to form an enclosure around power interface module 107. The housing allows access to the three poles of power port 151, the pair of input terminals of power port 170, shunt retainer 105 and power port 122. In one embodiment, top portion 102 of the housing includes a pair of testing slots 130-1 and 130-2. In one embodiment, top portion 102 of the housing is labeled to indicate the hot and return paths for the pair of input terminals of power port 170. In another embodiment, top portion 102 of the housing is labeled to indicate hot 130-1 and return 130-2 test slots. In one embodiment, top portion 102 of the housing is labeled to indicate that the pair of test slots 130-1 and 130-2 is for coaxial power.

In one embodiment, the horizontal surface of slide actuator 103 includes labels that indicate that slide actuator 103 is in a first position or a second position. When shunt retainer 105 fully disengages shunt 106 from header 160 or 162 slide actuator 103 moves retainer 105 over headers 160 and 162. When slide actuator 103 moves from a first position over header 160 to a second position over header 162 a first label is revealed while a second label is hidden and when slide actuator 103 moves from the second position to the first position, the second label is revealed as the first label is hidden. The first and second labels indicate which electrical path is being activated. Top portion 102 of the housing hides the labels. In one embodiment, top portion 102 includes a cut out that is aligned with the horizontal surface of slide actuator 103 so that the first label is hidden while the other label is revealed and vice versa.

In one embodiment, slide actuator 103 is labeled to indicate that power switch 100 is providing power from coaxial cabling and is also labeled to indicate that power switch 100 is providing power from twisted pair wiring. In one embodiment, the labeling is comprised of "COAX" and "TWP" indicating power from coaxial cabling and twisted pair wiring, respectively. Only the label indicating which position or type of power being utilized is visible at one time. The other label is not visible so that a mistake in wiring is prohibited.

In one embodiment, power switch 100 includes an actuator retainer 104 that is formed to provide the slide actuator 103 a platform to move from the first position to the second position and vice versa. The actuator retainer 104 acts as a guide for slide actuator 103, shunt 106 and shunt retainer 105. Actuator retainer 104 engages with power interface module 107 so that headers 160 and 162 extend into a first compartment 108 and a second compartment 118 of retainer 104, respectively. In one embodiment, retainer 104 includes a divider 128 that extends between the first and second compartments 108 and 118 that prohibits shunt 106 from engaging with the power interface module 107 in positions other than with header 160 or header 162 individually. For example, the divider 128 prohibits shunt 106 from engaging with a portion of the pins of header 160 and a portion of the pins of header 162. In addition, divider 128 and the first and second compartments 108 and 118 aid in prohibiting the pins of header 160 and 162 from being bent or damaged when moving the shunt 106 from the first position to the second position or vice versa.

In one embodiment, actuator retainer 104 provides a pair of test slot guides 141-1 and 141-2 leading from the test slots 130-1 and 130-2 in the housing to power port 122 of power interface module 107. In one embodiment, actuator retainer 104 is formed to aid in securing the power interface module 107, the shunt retainer 105, and the slide actuator 103 inside of the housing. The actuator retainer 104 is formed with grooves, notches, insets that match or mate with power interface module 107, shunt retainer 105, slide actuator 103 and the housing in order to hold these components securely in place.

In one embodiment, the housing that is comprised of the top portion 102 and the bottom portion 101 mated together is environmentally protected from moisture. In one embodiment, the housing is environmentally protected from ultra-violet degradation. In one embodiment, the top and bottom portions 101 and 102 of the housing are made of polyester. In one embodiment, the housing, the slide actuator 103, the shunt retainer 105 and the actuator retainer 104 are made of polyester. In one embodiment, the polyester is VALOX 357U.

In one embodiment, sliding power switch 100 is operable from −40 to +85 degrees Celsius. In another embodiment, sliding power switch 100 is operable from −35 to +65 degrees Celsius.

Figure 2:
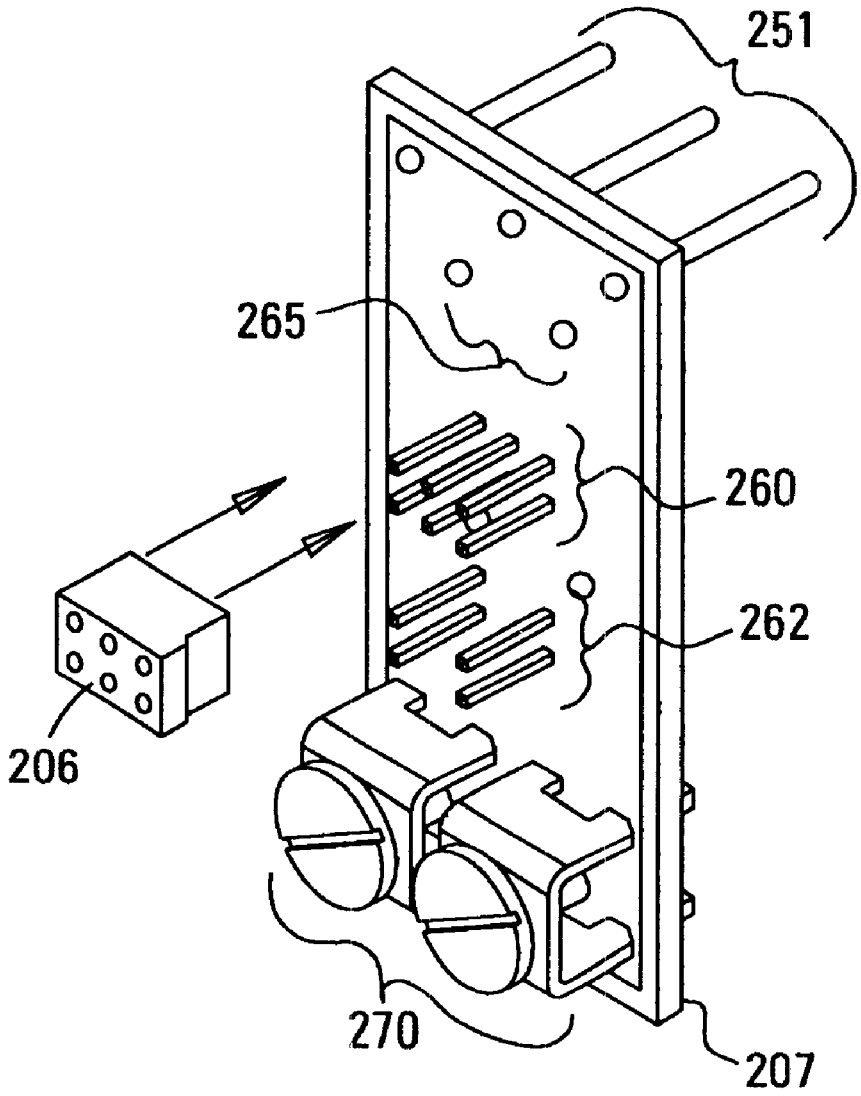
FIG. 2 is an illustration of a power interface module for one embodiment of a sliding power switch according to the teachings of this invention.

FIG. 2 is an illustration of a power interface module 207 for one embodiment of a sliding power switch constructed according to the teachings of this invention. Power interface module 207 enables one of two inputs to be connected to an output. In one embodiment, power interface module 207 comprises a printed circuit board, a wire-wrap board, or the like. Power interface module 207 includes a first power port 270, a second power port 265 and a third power port 251. In one embodiment, power port 270 comprises one of input terminals, screw terminals, insulation displacing connectors, binding posts, pins, screws, plugs, jacks or the like.

In one embodiment, power port 265 is a power input. In another embodiment, power port 265 is a power output. In an alternate embodiment, power port 265 is a power input in a first mode and a power output in a second mode. In one embodiment, power ports 265, 270 and 251 each comprise one of terminals, screw terminals, insulation displacing connectors, binding posts, pins, screws, plugs, jacks, sockets, contact points, or the like. In one embodiment, power port 251 comprises a set of three poles. In one embodiment, the three poles of power port 251 provide an output for power input via power port 270, in a first mode and provides an output for power input via power port 265, in a second mode. In one embodiment, the three poles of power port 251 comprises a first and a second output, the first output comprises two out of the three poles and the second power output comprises two different poles out of the three poles. In another embodiment, power input via power port 270 is output via power port 265, in a first mode and power input via power port 265 is output via power port 251 in a second mode. In one embodiment, power port 270 comprises a pair of screw terminals, power port 265 comprises a pair of receptacles and power port 251 comprises three poles.

In one embodiment, power interface module 207 includes a first set of pins 260 that form a first header and a second set of pins 262 that form a second header. In one embodiment, the first and second headers 260 and 262 are adapted to connect with shunt 206. Shunt 206 includes receptacles that receive the pins of headers 260 and 262. The pins of headers 260 and 262 are configured so that when coupled to shunt 206 power is allowed to flow through header 260 or 262, respectively. In one embodiment, header 260 couples to shunt 206 and produces a first electrical path from power port 270 to power port 265. In this embodiment, power port 265 is a power output. In another embodiment, header 262 couples to shunt 206 and produces a second electrical path from power port 265 to power port 251. In this embodiment, power port 265 is a power input. In one embodiment, the shunt 206 is a multi-position shunt that is capable of coupling with a variety of different headers.

In one embodiment, power interface module 207 is operable from −40 to +85 degrees Celsius. In another embodiment, power interface module 207 is operable from 35 to +65 degrees Celsius.

In operation, a power interface module such as 207 is includable in a power switch such as sliding power switch 100 described with respect to FIG. 1. In one embodiment, a sliding power switch such as 100 is part of a module that interfaces between a network such as the public switched telephone network, a cable network, the Internet, or the like and a subscriber's equipment. The module is powered through the power switch. In one embodiment, power is received over a transmission media such as a twisted pair line, coaxial cabling or the like. In another embodiment, power is received from an auxiliary source such as a battery. Power switch 100 is capable of switching between a first power source and a second power source, such as twisted pair and coaxial over a transmission media or battery power and auxiliary power direct to the power switch.

Figure 3:
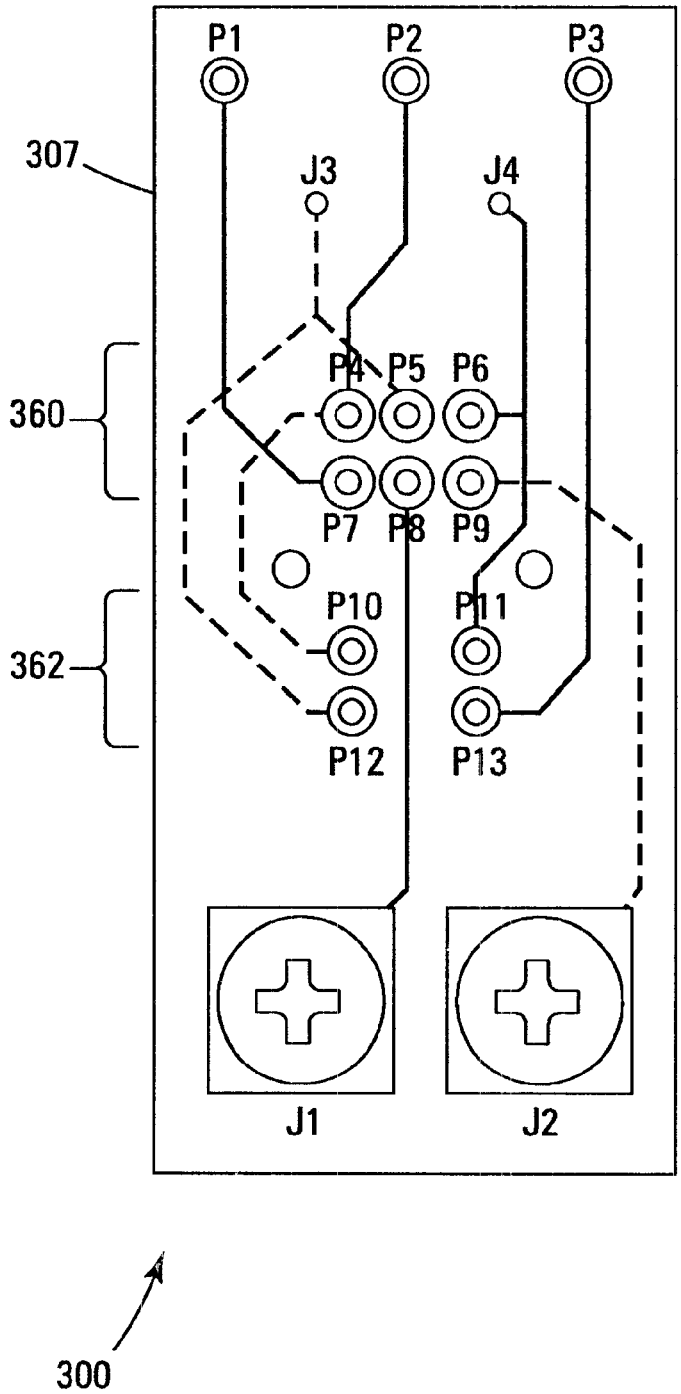
FIG. 3 is an illustration of a wiring diagram of one embodiment of a power interface module according to the teachings of this invention.

FIG. 3 is an illustration of a wiring diagram of one embodiment of a power interface module, shown generally at 300, constructed according to the teachings of this invention. In this embodiment, the power interface module is a printed circuit board 307 and includes power traces on the top face of printed circuit board 307 that are indicated by solid lines and power traces on the bottom face of printed circuit board 307 indicated by dotted lines. In one embodiment, P1, P2 and P3 represent a set of three poles and operate as a power output; J1 and J2 represent a pair of terminals and operate as a power input; J3 and J4 represent a pair of terminals and operate as a power output in a first mode and a power input in a second mode; P10–P13 represent a set of pins for a header 362; P4–P9 represent a set of pins for a header 360.

In the first mode, the pins of header 360 are engaged with a shunt, such as shunt 106, described with respect to figure 1. As a result P5 is coupled to P8, P6 is coupled to P9 and P4 is coupled to P7. In the second mode, the pins of header 362 are engaged with a shunt, such as shunt 106, and P12 is coupled to P10 and P11 is coupled to P13. In the first mode, power is input via J1 and J2, J1 is the hot terminal and J2 is the return terminal. Power is output via J3 and J4, J3 is the hot terminal and J4 is the return terminal. Power in at J1 is transported to J3 via P5 and P8 when they are coupled together. Power return to J2 is via J4 through P9 and P6 when they are coupled together. In one embodiment, P2 and P1 are shorted together via P4 and P7 when P4 and P7 are coupled together via a shunt. In the second mode, power is input via J3 and J4, J3 is the hot terminal, J4 is the return terminal and header 362 is engaged with a shunt. Power output is via P2 and P3, P2 is the hot terminal and P3 is the return terminal. Power in at J3 is transported to P2 via P10 and P12 when they are coupled together. Power return to J4 is via P3 through P11 and P13 when they are coupled together. It is understood that wiring diagram 300 is for example only and may comprise one of many different configurations to provide power output based on one of two inputs.

Figure 4:
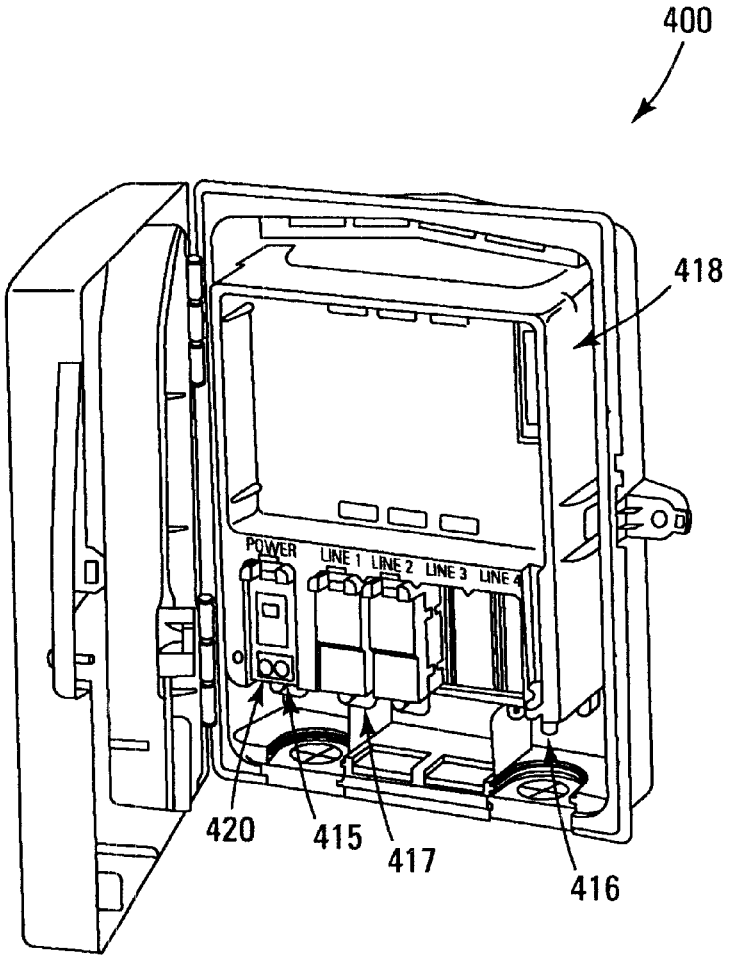
FIG. 4 is an illustration of one embodiment of an integrated service unit that includes one embodiment of a sliding power switch according to the teachings of this invention.

FIG. 4 is an illustration of an integrated service unit (ISU), shown generally at 400, comprising a sliding power switch 420 that is constructed according to the teachings of this invention. In one embodiment, ISU 400 includes a network interface 415 that receives input from networks such as a telephony network, a cable network, a hybrid fiber-coax network or the like. ISU 400 also includes a subscriber interface 416 for connection to subscriber equipment such as telephones, facsimile machines, computer systems, television sets to include set tops, cable modems and other data receivers and transceivers. In one embodiment, ISU 400 receives data from more than one network over more than one transmission media, for example data transmission over coaxial cable and telephone service over twisted pair. In another embodiment, ISU 400 receives data from more than one network over a single transmission medium, e.g., coaxial cable, hybrid fiber-coax, twisted pair or the like. In one embodiment, ISU 400 is a home-integrated services unit (HISU) designed for a single subscriber location. In one embodiment, the ISU 400 is capable of accommodating up to 2 lines of plain old telephone service (POTS) plus video. In another embodiment, the ISU 400 is capable of accommodating up to 2 additional POTS lines or symmetrical data services can be added. In an alternate embodiment, ISU 400 is a multiple dwelling integrated services unit (MISU) and accommodates a plurality or combination of POTS lines, symmetrical data services, T-1 lines, E-1 lines and the like. In a further embodiment, ISU 400 is a business integrated services unit (BISU) and accommodates one or more or a combination of one or more POTS lines, symmetrical data services, T-1 lines, E-1 lines and the like. It is understood that ISU 400 is not meant to be limited and may interface with any number of POTS lines, symmetrical data services, cable services, T-1 lines, E-1 lines and the like based on the application.

ISU 400 includes an electronics module 418 that communicates data between the network interface 415 and the subscriber interface 416. In one embodiment, electronics module 418 receives data and power at network interface 415. In one embodiment, electronics module 418 receives power via power switch 420. In one embodiment, power switch 420 is a sliding power switch such as sliding power switch 100 described with respect to FIG. 1. Power switch 420 plugs into the electronics module 418 of ISU 400. In one embodiment, electronics module 418 receives the three poles of power switch 420 and provides two input pins that extend to interconnect with a power port of power switch 420 such as power port 122 of power switch 100 described with respect to FIG. 1. In one embodiment, power switch 420 is rated for 250 volts and 3 amps. ISU 400 draws approximately 1 amp and operates on 60 VAC/48VDC. In one embodiment, ISU 400 is powered via the transmission media. Sliding power switch 420 is adapted to provide power to ISU 400 from a twisted pair, coaxial cabling or another power source internal or external to the ISU for example, battery back-up. In one embodiment, power is received over twisted pair by a pair of screw terminals of sliding power switch 420. The power is input to power switch 420 via the pair of screw terminals and output to the electronics module via a power port such as power port 122 of switch 100 of FIG. 1. In another embodiment, power is received via coaxial cabling coupled to network interface 415. The power is input into electronics module 418 and then transmitted to input pins that interface with the power port of power switch 420 when power switch 420 is "plugged into" electronics module 418. Power switch 420 includes a shunt retainer such as shunt retainer 105 of power switch 100, the power switch 420 allows selection of power between the input terminals and the power port of power switch 420. In one embodiment, power switch 420 is adapted to select between power received via twisted pair and coaxial cabling.

CONCLUSION

A sliding power switch has been described. The switch includes a power interface module having a first power port, a second power port and a third power port. The switch also includes a shunt adapted to engage with the power interface module in a first position so as to provide a first electrical path from one of the first, second, and third power ports to another one of the first, second, and third power ports and a second position so as to provide a second electrical path from one of the first, second, and third power ports to another of the first, second, and third power ports. The switch further includes a shunt retainer coupled to the shunt and adapted to aid in placing and removing the shunt from the first and second positions and a slide actuator adapted to engage with and enable the shunt retainer to slide from the first position to the second position.

Although specific embodiments have been illustrated and described herein, it will be appreciated by those of ordinary skill in the art that any arrangement, which is calculated to achieve the same purpose, may be substituted for the specific embodiments shown. For example the sliding power switch may receive power from any number of sources such as transmission media, direct power, auxiliary power, battery power or the like. The sliding power switch may receive power via one or more power ports other than screw terminals or sockets, it is understood that any type of inputs, outputs and power ports can be utilized for this invention. This application is intended to cover any adaptations or variations of the present invention. Therefore, it is intended that this invention be limited only by the claims and the equivalents thereof.

What is claimed is:

1. A sliding power switch, comprising:

a power interface module;

a first power port coupled to the power interface module;

a second power port coupled to the power interface module;

a third power port coupled to the power interface module;

a shunt adapted to engage with the power interface module in a first position so as to provide a first electrical path from one of the first, second, and third power ports to another one of the first, second, and third power ports and a second position so as to provide a second electrical path from one of the first, second, and third power ports to another of the first, second, and third power ports;

a shunt retainer coupled to the shunt and adapted to aid in placing and removing the shunt from the first and second positions;

a slide actuator adapted to engage with and enable the shunt retainer to slide from the first position to the second position; and wherein when the shunt is engaged in the second position the slide actuator extends to disable one of the first, second, and third power ports.

2. The switch of claim 1, wherein when the shunt is engaged in the first position the first power port is a power output.

3. The switch of claim 1, wherein when the shunt is engaged in the second position the first power port is a power input.

4. The switch of claim 1, further comprising a first header and a second header electrically coupled to the power interface module, wherein the shunt engages with the first header in the first position and engages with the second header in the second position.

5. The switch of claim 1, further comprising an actuator retainer adapted to engage with the slide actuator and provide a platform for the slide actuator to move from the first position to the second position.

6. The switch of claim 5, wherein the actuator retainer includes a divider that separates the actuator retainer into a first and a second compartment.

7. The switch of claim 1, wherein the first power port comprises a pair of sockets.

8. The switch of claim 1, wherein the second power port comprises a pair of screw terminals.

9. The switch of claim 1, wherein the third power port comprises a set of three poles.

10. The switch of claim 1, further comprising a housing that encloses the power interface module and provides access to the first, second and third power ports and the shunt retainer.

11. The switch of claim 10, wherein the housing is made of polyester.

12. The switch of claim 10, further comprising one or more testing slots in the housing located to facilitate testing for power to the switch.

13. A sliding power switch, comprising a power interface module;

a first power port coupled to the power interface module;

a second power port coupled to the power interface module;

a third power port coupled to the power interface module;

a shunt adapted to engage with the power interface module in a first position and a second position;

a shunt retainer coupled to the shunt and adapted to aid in placing and removing the shunt from the first and second positions;

a slide actuator adapted to engage with and enable the shunt retainer to slide from the first position to the second position;

an actuator retainer adapted to engage with the slide actuator and provide a platform for the slide actuator to move from the first position to the second position; and a first header and a second header electrically coupled to the power interface module, wherein the shunt engages with the first header in the first position and engages with the second header in the second position.

14. The switch of claim 13, wherein the actuator retainer includes a divider that separates the actuator retainer into first and second compartments, wherein the actuator retainer engages with the power interface module so that the first header and the second header extend into the first compartment and the second compartment, respectively.

15. The switch of claim 13, wherein the slide actuator is adapted to engage with and enable the shunt retainer to slide from the first position to the second position once the shunt has been fully disengaged from the power interface module.

16. The switch of claim 13, further comprising a housing that encloses the power interface module and provides access to the first, second and third power ports and the shunt retainer.

17. The switch of claim 16, wherein the housing is made of polyester.

18. The switch of claim 16, further comprising one or more testing slots in the housing located to facilitate testing for power to the switch.

19. The switch of claim 13, wherein when the shunt is engaged in the second position the slide actuator extends to disable one of the first, second, and third power ports.

20. The switch of claim 13, wherein when the shunt is engaged in the first position the first power port is a power output.

21. The switch of claim 13, wherein when the shunt is engaged in the second position the first power port is a power input.

22. A sliding power switch, comprising:

a power interface module;

a power input coupled to the power interface module;

a power port coupled to the power interface module;

a power output coupled to the power interface module;

a shunt adapted to engage with the power interface module in a first position so as to provide a first electrical path from the power input to the power port and a second position so as to provide a second electrical path from the power port to the power output;

a shunt retainer coupled to the shunt and adapted to aid in placing and removing the shunt from the first and second positions; and a slide actuator adapted to engage with and enable the shunt retainer to slide from the first position to the second position, wherein when the shunt is engaged in the second position the slide actuator extends to disable the power input.

23. The switch of claim 22, wherein when the shunt is engaged in the first position the power port is a power output.

24. The switch of claim 22, wherein when the shunt is engaged in the second position the power port is a power input.

25. The switch of claim 22, further comprising a first header and a second header electrically coupled to the power interface module, wherein the shunt engages with the first header in the first position and engages with the second header in the second position.

26. The switch of claim 22, further comprising an actuator retainer adapted to engage with the slide actuator and provide a platform for the slide actuator to move from the first position to the second position.

27. The switch of claim 22, wherein the shunt comprises a multi-position shunt.

28. The switch of claim 22, wherein the power output comprises at least one pole.

29. The switch of claim 22, wherein the power output comprises three poles.

30. The switch of claim 22, wherein the slide actuator is adapted to engage with and enable the shunt retainer to slide from the first position to the second position once the shunt has been fully disengaged from the power interface module.

31. The switch of claim 22, wherein the power interface module comprises a printed circuit board.

32. The switch of claim 22, wherein the power input comprises a pair of screw terminals.

33. The switch of claim 22, wherein the power port comprises a pair of sockets.

34. The switch of claim 22, wherein the power input is adapted to receive power via a twisted pair.

35. The switch of claim 22, wherein the power port is adapted to receive power via a coaxial cable.

36. The switch of claim 22, wherein the shunt retainer is further adapted to seat in place with the slide actuator when the shunt is engaged in the first or second positions.

37. The switch of claim 22, further comprising a housing that encloses the power interface module and provides access to the power input, the power port, the power output, and the shunt retainer.

38. The switch of claim 37, wherein the housing is environmentally protected from moisture.

39. The switch of claim 37, wherein the housing is environmentally protected from ultra violet degradation.

40. The switch of claim 37, wherein the housing is made of polyester.

41. The switch of claim 37, further comprising one or more testing slots in the housing located to facilitate testing for power to the switch.

42. The switch of claim 41, wherein the one or more testing slots are located to facilitate testing for power input to the switch via the power port.

43. The switch of claim 41, wherein when the shunt is engaged in the first position the slide actuator extends to disable the one or more testing slots.

44. An integrated service unit, comprising:

an electronics module;

a network interface coupled to the electronics module;

a subscriber interface coupled to the electronics module; and a power selection switch that includes:

a power interface module;

a power input coupled to the power interface module;

a power port coupled to the power interface module;

a power output coupled to the power interface module;

a shunt adapted to engage with the power interface module in a first position so as to provide a first electrical path from the power input to the power port and a second position so as to provide a second electrical path from the power port to the power output;

a shunt retainer coupled to the shunt and adapted to aid in placing and removing the shunt from the first and second positions; and a slide actuator adapted to engage with and enable the shunt retainer to slide from the first position to the second position, wherein when the shunt is engaged in the second position the slide actuator extends to disable the power input.

45. The integrated service unit of claim 44, wherein the power selection switch further comprises a first and a second header electrically coupled to the power interface module, wherein the shunt engages with the first header in the first position and engages with the second header in the second position.

46. The integrated service unit of claim 44, wherein the power selection switch further comprises an actuator retainer adapted to engage with the slide actuator and provide a platform for the slide actuator to move from the first position to the second position.

47. The integrated service unit of claim 44, wherein the power input of the power selection switch is adapted to receive power via a twisted pair.

48. The integrated service unit of claim 44, wherein when the shunt is engaged in the first position the power port is a power output.

49. The integrated service unit of claim 44, wherein when the shunt is engaged in the second position the power port is a power input.

50. The integrated service unit of claim 44, wherein the power port of the power selection switch is adapted to receive power via a coaxial cable.

51. The integrated service unit of claim 44, wherein the shunt comprises a multi-position shunt.

52. The integrated service unit of claim 44, wherein the slide actuator is adapted to engage with and enable the shunt retainer to slide from the first position to the second position once the shunt has been fully disengaged from the power interface module.

53. The integrated service unit of claim 44, wherein the power interface module comprises a printed circuit board.

54. The integrated service unit of claim 44, wherein the power input comprises a pair of screw terminals.

55. The integrated service unit of claim 44, wherein the power port comprises a pair of sockets.

56. The integrated service unit of claim 44, wherein the shunt retainer is further adapted to seat in place with the slide actuator when the shunt is fully engaged in the first or second positions.

57. The integrated service unit of claim 44, wherein the power selection switch further comprises a housing that encloses the power interface module and provides access to the power input, the power port, the power output and the shunt retainer.

58. The integrated service unit of claim 57, wherein the housing is environmentally protected from ultra violet degradation.

59. The integrated service unit of claim 57, wherein the housing is made of polyester.

60. The integrated service unit of claim 57, wherein the housing for the power selection switch comprises a pair of testing slots located to facilitate testing for power to the switch.

61. The integrated service unit of claim 60, wherein when the shunt is engaged in the first position the slide actuator extends to disable the testing slots.

62. The integrated service unit of claim 44, wherein the power output comprises at least one pole.

63. The integrated service unit of claim 44, wherein the power output comprises three poles.

64. A switch, comprising:

a power interface module;

a power input coupled to the power interface module;

a power port coupled to the power interface module;

a power output coupled to the power interface module;

a first header electrically coupled to the power interface module;

a second header electrically coupled to the power interface module;

a shunt adapted to engage with the first header so as to provide a first electrical path from the power input to the power port and a second header so as to provide a second electrical path from the power port to the power output and wherein when the shunt is engaged with the first header the slide actuator extends to disable the power port;

a shunt retainer adapted to engage with the shunt and aid in placing and removing the shunt from the first and second headers; and a slide actuator adapted to engage with and enable the shunt retainer to slide from a first position to a second position, wherein the first position is located above the first header and the second position is located above the second header.

65. The switch of claim 64, wherein the power interface module comprises a printed circuit board.

66. The switch of claim 64, wherein the power port is a power output when the shunt is engaged with the first header.

67. The switch of claim 64, wherein the power port is a power input when the shunt is engaged with the second header.

68. The switch of claim 64, wherein the power output comprises three poles.

* * * * *